US006751292B2

(12) United States Patent
Andrews et al.

(10) Patent No.: US 6,751,292 B2
(45) Date of Patent: Jun. 15, 2004

(54) X-RAY TUBE ROTOR ASSEMBLY HAVING AUGMENTED HEAT TRANSFER CAPABILITY

(75) Inventors: Gregory C. Andrews, Sandy, UT (US); Vaughn Leroy Barrett, West Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 38 days.

(21) Appl. No.: 10/223,133

(22) Filed: Aug. 19, 2002

(65) Prior Publication Data

US 2004/0032929 A1 Feb. 19, 2004

(51) Int. Cl.[7] ..... H01J 35/28
(52) U.S. Cl. ..... 378/132; 378/130
(58) Field of Search ..... 378/132, 133, 378/130

(56) References Cited

U.S. PATENT DOCUMENTS

| | | | | |
|---|---|---|---|---|
| 3,735,176 | A | | 5/1973 | Langer et al. |
| 3,855,492 | A | | 12/1974 | Langer et al. |
| 3,942,059 | A | | 3/1976 | Tran-Quang |
| RE30,082 | E | | 8/1979 | Atlee et al. |
| 4,187,442 | A | | 2/1980 | Hueschen et al. |
| 4,272,696 | A | | 6/1981 | Stroble et al. |
| 4,470,645 | A | | 9/1984 | Lauwasser |
| 4,870,672 | A | | 9/1989 | Lindberg |
| 4,949,368 | A | | 8/1990 | Kubo |
| 4,953,190 | A | | 8/1990 | Kukoleck et al. |
| 4,988,534 | A | | 1/1991 | Upadhya |
| 5,056,126 | A | | 10/1991 | Klosterman et al. |
| 5,148,463 | A | | 9/1992 | Woodruff et al. |
| 5,150,397 | A | | 9/1992 | Randzaao |
| 5,157,706 | A | | 10/1992 | Hohenauer |
| 5,159,619 | A | | 10/1992 | Benz et al. |
| 5,308,172 | A | | 5/1994 | Upadhya et al. |
| 5,414,748 | A | | 5/1995 | Upadhya |
| 5,553,114 | A | | 9/1996 | Siemers et al. |
| 5,838,762 | A | | 11/1998 | Ganin et al. |
| RE36,405 | E | | 11/1999 | Akita et al. |
| 6,011,829 | A | * | 1/2000 | Panasik ..... 378/130 |
| 6,041,100 | A | | 3/2000 | Miller et al. |
| 6,125,168 | A | | 9/2000 | Bhatt |
| 6,125,169 | A | | 9/2000 | Wandke et al. |
| 6,144,720 | A | | 11/2000 | DeCou et al. |

* cited by examiner

*Primary Examiner*—Craig E. Church
(74) *Attorney, Agent, or Firm*—Workman Nydegger

(57) ABSTRACT

A rotor assembly capable of augmented heat transfer within an x-ray tube is disclosed for preventing heat damage to sensitive tube components. The rotor assembly generally comprises a shaft assembly for supporting the anode, a bearing assembly including a bearing housing and bearing sets for enabling rotation of the shaft assembly, and a magnetic sleeve. The shaft assembly includes a rotor sleeve that receives heat emitted by the anode during tube operation. The rotor sleeve radiates the heat to the magnetic sleeve, which is concentrically disposed within the rotor sleeve. A coolant-filled gap is defined adjacent the inner surface of the magnetic sleeve to receive the heat absorbed by the magnetic sleeve. The inner periphery of the gap is defined by the outer surface of the bearing housing. Emissive and absorptive coatings are disposed on the various surfaces of the rotor sleeve and magnetic sleeve to enhance heat transfer therebetween.

38 Claims, 4 Drawing Sheets

X-RAY TUBE ROTOR ASSEMBLY HAVING AUGMENTED HEAT TRANSFER CAPABILITY

BACKGROUND OF THE INVENTION

1. The Field of the Invention

The present invention generally relates to x-ray generating devices. More particularly, the present invention relates to an x-ray tube rotor assembly having superior cooling characteristics.

2. The Related Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, then impinged upon a material of a particular composition. This process typically takes place within an x-ray tube located in the x-ray generating device.

The x-ray tube generally comprises an outer housing in which is disposed a substantially cylindrical vacuum enclosure. The vacuum enclosure has disposed therein a cathode and an anode. The cathode includes a filament that, when heated via an electrical current, emits a stream of electrons. The anode typically comprises a graphite substrate upon which is disposed a heavy metallic target surface that is oriented to receive the electrons emitted by the cathode. Though some x-ray tube anodes are stationary, many are rotatably supported within the vacuum enclosure by a rotor assembly.

The rotor assembly typically comprises a rotor shaft, a rotor hub and sleeve, a bearing assembly and a magnetic sleeve. One end of the rotor shaft supports the rotary anode, while the other end is attached to the rotor hub and sleeve. The rotor hub interconnects the rotor shaft and the rotor sleeve with the bearing assembly, thereby enabling the shaft and sleeve to rotate. The rotor sleeve is rotationally and concentrically disposed about a substantial portion of the bearing assembly. A stator is used to induce rotation of the rotor sleeve, which in turn causes the rotor shaft and anode to rotate. The magnetic sleeve typically attaches to and covers either the outer surface of the bearing housing or the inner surface of the rotor sleeve to assist the stator in inducing rotation of the rotor sleeve.

In order for the x-ray tube to produce x-rays, an electric current is supplied to the cathode filament of the x-ray tube, causing it to emit a stream of electrons by thermionic emission. A high voltage potential placed between the cathode and the anode causes the electrons in the electron stream to gain kinetic energy and accelerate toward the target surface located on the anode. Upon striking the target surface, many of the electrons convert their kinetic energy into electromagnetic radiation of very high frequency, i.e., x-rays. The specific frequency of the x-rays produced depends in large part on the type of material used to form the anode target surface. Target surface materials having high atomic numbers ("Z numbers"), such as tungsten carbide or TZM (an alloy of titanium, zirconium, and molybdenum) are typically employed. Finally, the x-ray beam passes through windows defined in the vacuum enclosure and outer housing, where it is directed to an x-ray subject, such as a medical patient.

A recurrent problem encountered with the operation of x-ray tubes deals with the removal of heat from tube components. In general, only a small percentage of the electrons that impact the anode target surface during x-ray production do, in fact, produce x-rays. The majority of the kinetic energy is instead released as heat that is absorbed into the anode target surface and surrounding areas. This heat must be continuously and reliably removed from the anode and surrounding components in order to prevent damage to critical tube components. To the extent that the heat is efficiently removed, less thermal and mechanical stress is imposed upon the x-ray tube, and its operation and performance will be enhanced. If the heat is allowed to reach detrimental levels, however, it can damage the anode and/or other tube components, and can reduce the operating life of the x-ray tube and/or the performance and operating efficiency of the tube.

Many approaches have been implemented to help alleviate the problems created by heating within the x-ray tube. For instance, as noted the anode in many x-ray tubes is rotatable. During operation of the x-ray tube, the rotary anode is rotated at high speeds, which causes successive portions of the target surface to continuously rotate into and out of the path of the electron beam produced by the cathode filament. In this way, the electron beam is in contact with any given point on the target surface for only short periods of time. This allows the remaining portion of the surface to cool during the time that it takes to rotate back into the path of the electron beam, thereby reducing the amount of heat that is absorbed by the anode at any given location.

While the rotating nature of the anode reduces the amount of heat present at the target surface, a large amount of heat is still absorbed by the anode substrate and other components within the vacuum enclosure. Of particular concern is the heat that is conducted from the anode to the rotor assembly, and specifically to the bearing assembly. Excessively high temperatures produced in the anode and conducted through the rotor shaft to the bearing sets can melt the thin metal lubricant that surrounds the bearings. This can cause the lubricant to disperse and expose the bearings to excessive friction. The lubricant may also form clumps in the presence of excessive heat, which in turn causes the bearing assembly to create excessive noise and mechanical vibration during tube operation. Such conditions can reduce the x-ray tube's operating efficiency and even image quality. Repeated exposure to high temperatures can gradually degrade the integrity of the bearing surfaces and reduce their useful life or even cause premature bearing failure. Therefore, it is important to reliably and continuously dissipate heat from the x-ray tube, and particularly from the bearing assembly.

In an effort to remove large quantities of heat within the x-ray tube, rotor sleeves have been designed to absorb heat from the rotor shaft and then to radiate that heat to the surrounding vacuum enclosure. While assisting in limiting the amount of heat transmitted by the rotor shaft to the bearing assembly, this approach alone may not be sufficient to prevent large quantities of heat from reaching the bearing sets.

Another technique used for removing heat from an x-ray tube is to place the vacuum enclosure within an outer housing, as mentioned above. The outer housing serves as a container for a coolant, such as a dielectric oil, which surrounds and envelops the vacuum enclosure, and which may be continuously circulated by a pump about the outer surface thereof. As heat is emitted from the x-ray tube components (the anode, support shaft, etc.), it is radiated to the outer surface of the vacuum enclosure, and then at least partially absorbed by the dielectric oil. The heated oil is then passed to some form of heat exchange device, such as a radiative surface, to be cooled. The oil is then re-circulated by the pump back through the outer housing and the process repeated.

While assisting greatly in the dissipation of heat from the x-ray tube, the coolant is a only of partial assistance when attempting to directly remove heat from the bearing housing. This is due to the fact that in typical x-ray tubes, the coolant is only able to directly circulate past a small portion of the bearing housing, namely the bearing shank, which is disposed at the bottom of the bearing assembly. The rest of the bearing housing is typically prevented from direct contact with the coolant by the surrounding vacuum enclosure. Because of this typical design, effective cooling of the bearing assembly, and specifically the bearing sets, is difficult to achieve.

In light of the above discussion, a need exists to provide adequate cooling to the rotor assembly of an x-ray tube, and particularly to the bearing assembly, thereby avoiding the problems outlined above.

BRIEF SUMMARY OF THE INVENTION

The present invention has been developed in response to the above and other needs in the art. Briefly summarized, embodiments of the present invention are directed to an x-ray tube rotor assembly having a structure that enables sufficient cooling thereof during tube operation. In particular, an x-ray tube utilizing the rotor assembly as disclosed and described herein is better able to reduce excessive heating of the bearing sets that may undesirably occur with known tube designs.

In a first embodiment, the present x-ray tube rotor assembly generally comprises a shaft assembly, a bearing assembly and a magnetic sleeve. Both assemblies and the magnetic sleeve are either disposed substantially within, or are attached to a vacuum enclosure, which in turn is preferably disposed within a coolant-filled outer housing. The coolant, such as a dielectric oil, is first circulated through the outer housing to remove heat from the x-ray tube, then through a heat exchanger to cool it before being re-circulated into the outer housing. The present rotor assembly cooperates with the coolant to achieve effective and continuous cooling of the assembly.

The shaft assembly of the present rotor assembly comprises a rotor hub from which extends a rotor shaft that supports the anode. Extending from rotor hub in the opposite direction is a hollow, cylindrical rotor sleeve that concentrically envelops a substantial portion of the bearing assembly. The shaft assembly of the rotor assembly is cooperatively attached to the bearing assembly via a bearing shaft, which enables rotation of the shaft assembly.

The bearing assembly of the present rotor assembly generally comprises the bearing shaft, bearing sets, a bearing housing and a magnetic sleeve. The bearing housing includes an axial cavity in which is disposed the bearing shaft. Two bearing sets are interposed near either end of the axial cavity between the bearing housing and the bearing shaft, to enable rotation of the bearing shaft relative the bearing housing. The base of the bearing housing comprises a shank that is supported by a collet.

The magnetic sleeve comprises an open, hollow cylinder having circular first and second ends. The magnetic sleeve is attached at its first end to the outer surface of the bearing housing such that it is concentrically disposed between the outer surface of the housing and the inner surface of the rotor sleeve. The second end of the magnetic sleeve is hermetically attached to the lower end of the vacuum enclosure such that the enclosure is structurally supported by the sleeve. A sealing ring is preferably interposed between the vacuum enclosure and the magnetic sleeve to enhance the seal therebetween.

The attachment of the first end of the magnetic sleeve to the outer surface of the bearing housing is such that a longitudinally extending gap is defined between the inner surface of the magnetic sleeve and the housing. The gap extends for the length of the magnetic sleeve, and is in fluid communication with the coolant disposed about the vacuum enclosure. This enables coolant to infiltrate the gap and directly circulate about a significant portion of the outer surface of the bearing housing.

During operation of the x-ray tube, heat absorbed by the rotor shaft from the anode is partially directed through the rotor hub to the rotor sleeve. This heat is partially radiated outward from the rotor sleeve toward the vacuum enclosure, but is also radiated inward toward the outer surface of the magnetic sleeve. The heat is absorbed by the outer surface of the magnetic sleeve, then transferred by the inner surface of the magnetic sleeve to the coolant circulating within the gap. Upon exiting the gap, the coolant completes its travel through the outer housing before exiting the tube for cooling prior to recirculation. In one embodiment, emissive and absorptive surfaces are preferably disposed on the rotor sleeve and magnetic sleeve to facilitate the radiation of heat therebetween. The above heat removal process occurs continuously during operation of the x-ray tube.

In addition to facilitating enhanced heat removal from the rotor sleeve and magnetic sleeve, the present rotor assembly also assists in directly cooling the bearing housing. By virtue of its proximity to the gap, a significantly larger portion of the outer surface of the bearing housing is in direct contact with circulating coolant disposed within the outer housing of the x-ray tube. Thus, augmented heat transfer between the bearing housing and the circulating coolant is achieved as compared with prior art bearing assemblies.

In an alternative embodiment, fluid passageways are defined in the collet to facilitate enhanced circulation of coolant in the gap, thereby leading to even more effective rotor assembly cooling. Further, a plurality of tubes may be disposed in the fluid passageways to direct the flow of coolant within the gap for increased heat transfer.

In another alternative embodiment, the outer periphery of the gap is not defined by the magnetic sleeve, but rather by a cylindrical sleeve extending from the bearing housing to the bottom of the vacuum enclosure. This design may be used, for instance, where the magnetic sleeve is not attached to the bearing housing as described in the first embodiment, but is rather affixed to the inner surface of the rotor assembly.

As a result of the design of the present invention, heat removal from the rotor assembly is greatly enhanced. Specifically, relatively greater heat transfer through the rotor sleeve and the bearing housing work to prevent excessive build up of heat within the bearing assembly, thereby reducing the possibility of damage to the bearing sets disposed therein. Thus, the longevity of the rotor assembly is improved and/or the ability of the tube to be run at higher anode operating temperatures is increased.

These and other objects and features of the present invention will become more fully apparent from the following description and appended claims, as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale. Additionally, it is noted that words such as top, bottom, upper, lower, and the like are merely descriptive terms that are used to enable a sufficient description to be made of the present invention. Such words, therefore, are not meant to restrict the present invention in any way FIGS. 1–4 depict various features of embodiments of the present invention, which is generally directed to a rotor assembly for use in an x-ray generating apparatus. The rotor assembly of the present invention allows for greater cooling of the bearing assembly of the apparatus, particularly the bearing sets.

Figure 1:
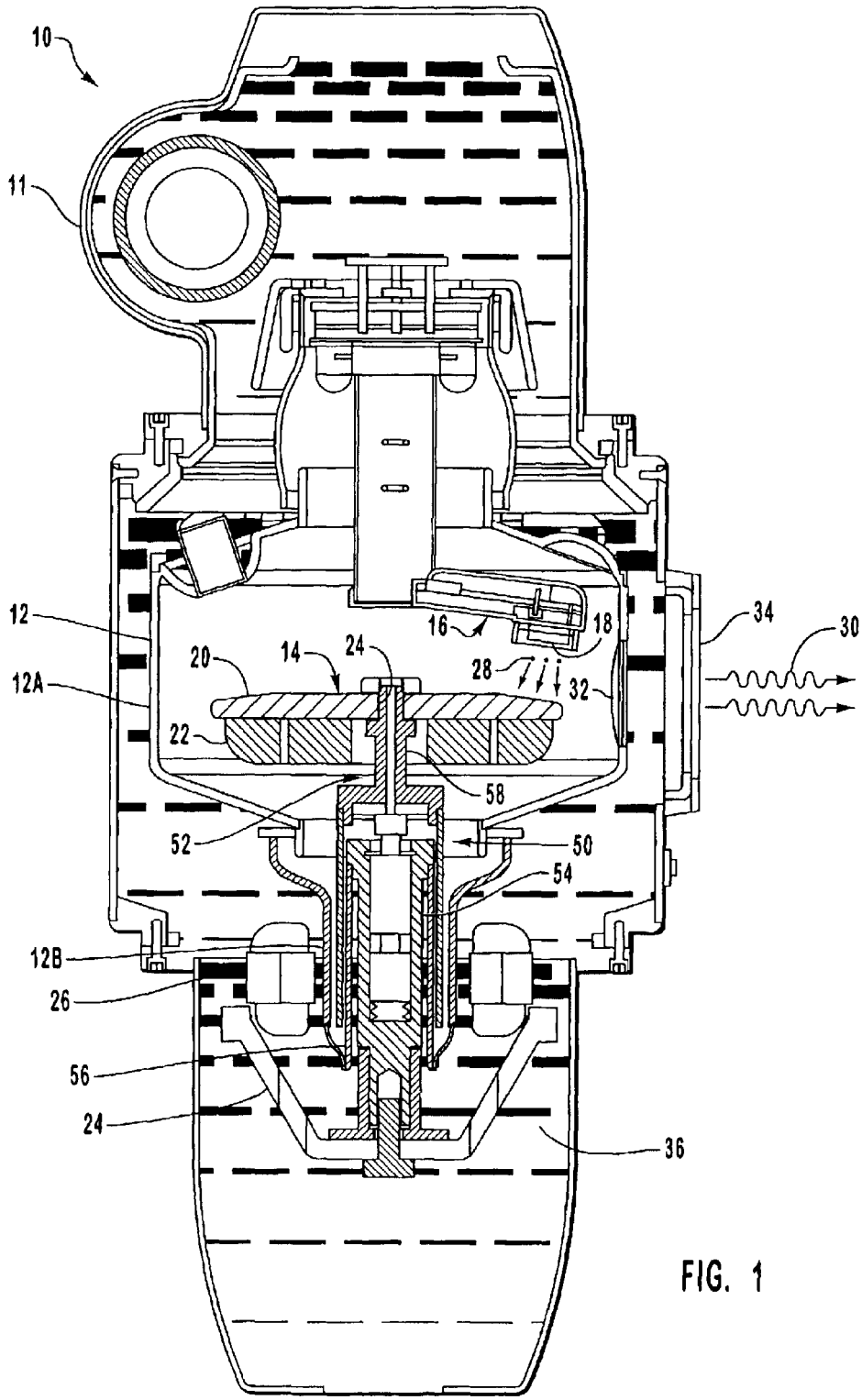
FIG. 1 is a cross sectional view of an x-ray tube wherein features of a first embodiment of the present rotor assembly are shown.

Reference is first made to FIG. 1, which depicts an x-ray tube 10 incorporating features of the present invention. The x-ray tube 10, shown here in cross-section, preferably includes an outer housing 11 in which is disposed a vacuum enclosure 12. While other configurations could be used, in this embodiment, the vacuum enclosure generally comprises a cylindrical top section 12A that is attached to a bottom section 12B. The bottom section 12B is also substantially cylindrical and comprises a smaller diameter than that of the top section 12A. The top and bottom sections 12A and 12B may be formed integrally, or may be separately manufactured, then hermetically joined together.

A rotary anode 14, and a cathode 16 are disposed inside the vacuum enclosure 12. The anode 14 is spaced apart from and oppositely disposed to the cathode 16 to receive electrons emitted by a filament 18 disposed in the cathode. A target surface 20, typically comprising a heavy metallic material, is disposed on a graphite substrate 22 of the anode 14.

The rotor assembly 50 is also shown in further detail in FIG. 1. A primary function of the rotor assembly 50 is to rotatably support the anode 14. The rotor assembly 50, in turn, is structurally supported by an anode support cone 24 or other suitable structure. A stator 26 is typically employed to induce rotation of the rotor assembly 50, which in turn rotates the anode 14 during tube operation. More details concerning the rotor assembly 50 are given below.

In order for the x-ray tube 10 to produce x-rays, the anode 14 and the cathode 16 are electrically biased such that a high voltage potential is established between them. An electric current is then passed through the filament 18, causing a cloud of electrons, designated at 28, to be emitted from the filament by thermionic emission.

An electric field created by the high voltage potential existing between the anode 14 and the cathode 16 causes the electron cloud 28 to accelerate from the cathode toward the target surface 20 of the rotating anode. As they accelerate toward the target surface 20, the electrons 28 gain a substantial amount of kinetic energy. Upon approaching and impacting the anode target surface 20, the electrons 28 are rapidly decelerated. Some of the resultant kinetic energy is converted into electromagnetic waves of very high frequency, i.e., x-rays. The resulting x-rays, designated at 30, emanate from the anode target surface 20 and are collimated through windows 32 and 34 disposed in the vacuum enclosure 12 and the outer housing 111, respectively. The collimated x-rays 30 are then directed for penetration into an object, such as an area of a patient's body. As is well known, the x-rays 30 that pass through the object can be detected, analyzed, and used in any one of a number of applications, such as x-ray medical diagnostic examination or materials analysis procedures.

A coolant 36, such as a dielectric oil, is typically disposed within the outer housing 11 such that it envelops the vacuum enclosure 12. The coolant 36 is continuously circulated through the outer housing 11 during tube operation by way of a pump or other fluid moving device (not shown) in order to remove heat from the outer surface of the vacuum enclosure 12 and other tube components. Often a closed coolant circulation system (not shown) is integrated with the x-ray tube 10 such that the coolant 36 is introduced at one end of the outer housing 11, is circulated about the vacuum enclosure 12, and is then ejected from an opposite end of the housing. The coolant 36 is then typically cooled by circulation through a heat exchanger (not shown) before being re-introduced into the outer housing 11.

Figure 2:
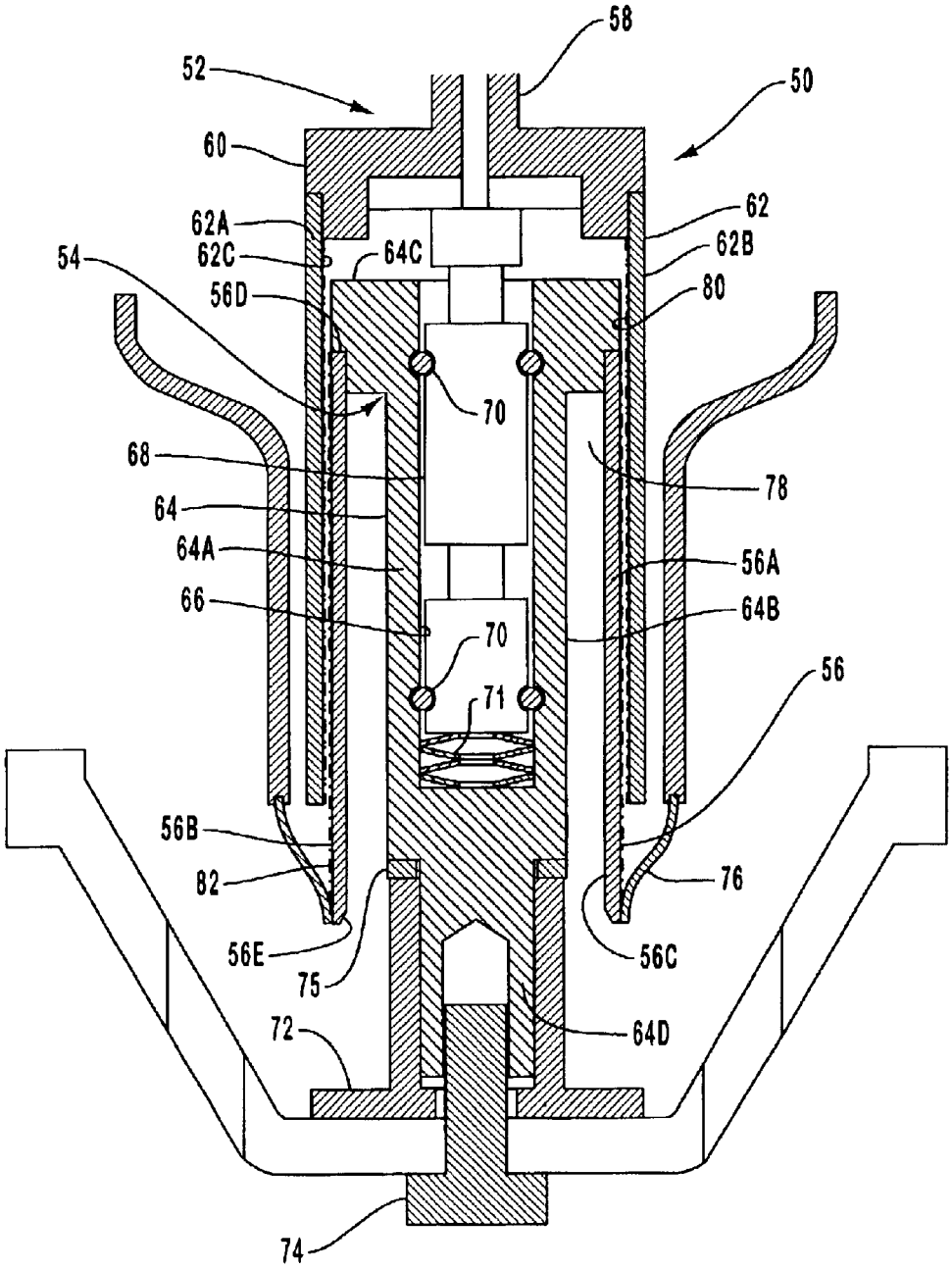
FIG. 2 is a cross sectional view of a first embodiment of the present rotor assembly, depicting various features thereof.

Reference is now made to FIG. 2, which depicts various features of a first embodiment of the present rotor assembly 50. As mentioned above, the rotor assembly 50 utilizes an improved structure to enhance the cooling of the bearing assembly and associated components during tube operation.

In the embodiment of FIG. 2, the rotor assembly 50 generally includes a shaft assembly 52, a bearing assembly 54, and a magnetic sleeve 56. The shaft assembly 52 is primarily responsible for structurally supporting the anode 14 within the vacuum enclosure 12 and includes a rotor shaft 58, a rotor hub 60, and a rotor sleeve 62. The rotor shaft 58 connects at one end to the anode 14, and at the other end to the disk-shaped rotor hub 60. The rotor sleeve 62 is also attached to the rotor hub 60 such that it concentrically extends down about a substantial portion of the bearing assembly 54. Preferably composed substantially of copper or a copper alloy, the rotor sleeve 62 comprises a hollow cylindrical body 62A, an outer surface 62B, and an inner surface 62C.

The bearing assembly 54 of the rotor assembly 50 provides the rotational components necessary to allow the shaft assembly 52 described above to rotate during tube operation. A substantially cylindrical bearing housing 64 forms the core of the bearing assembly 54, and includes a body 64A, and outer surface 64B, a head portion 64C, a rear shank portion 64D, and an axial cavity 66. A bearing shaft 68 is disposed in the cavity 66 such that one end thereof extends beyond the bearing housing 64 through the opening of the cavity in the head portion 64C. The bearing shaft 68 is attached to the rotor hub 60 through any suitable mode of attachment, including mechanical fasteners such as screws (not shown). The bearing housing 64 is typically substantially composed of a metal, such as steel or copper.

The bearing shaft 68 is allowed to rotate within the cavity 66 via two bearing sets 70 interposed between the shaft and the cavity. Preferably ball bearing-type sets are used, though it is appreciated that other varieties of rotational components could be employed as well to facilitate the rotation of the bearing shaft 68. One each of the bearing sets 70 is disposed in the cavity 66 both in the head portion 64C and near the rear shank portion 64D. In the illustrated embodiment, the position of the bearing shaft 68 within the cavity 66 is at least partially maintained by a wave spring 71 disposed at one end of the cavity.

The bearing assembly 54 is structurally supported within the outer housing 11 by zoo the anode support cone 24. A collet 72 is attached to a portion of the anode support cone 24 via a bolt 74 or other suitable mechanical fastener, and is sized and configured to receive a portion of the rear shank portion 64D of the bearing housing 64. In the illustrated embodiment, an alignment washer 75 is interposed between the collet 72 and the bearing housing 64.

The magnetic sleeve 56 comprises the third major component of the rotor assembly 50, together with the shaft assembly 52 and the bearing assembly 54. The magnetic sleeve 56 is an important component in an x-ray tube in that it cooperates with the stator 26 to facilitate inductive rotation of the rotor sleeve 62. Thus, the magnetic sleeve typically is at least substantially composed of a ferromagnetic material, such as iron. The magnetic sleeve 56 comprises a hollow, open-ended cylindrical body 56A having inner and outer surfaces 56B and 56C, and first and second ends 56D and 56E, respectively. In the illustrated embodiment, the first end 56D is attached via welding, brazing, or other suitable method to the outer surface 64B of the bearing housing head portion 64C. The second end 56E is attached via welding, brazing or other suitable method to a sealing ring 76, which in turn is attached to the bottom section 12B of the vacuum enclosure 12. Note that the joints between the bearing housing 64, the magnetic sleeve 56, the sealing ring 76, and the bottom section 12B of the vacuum enclosure 12 are hermetic such that a vacuum is maintained within the enclosure. Note also that in this arrangement, the magnetic sleeve 56 structurally supports the vacuum enclosure 12. This arrangement is desirable to enable the present rotor assembly 50 to dissipate heat in an enhanced manner, as described more fully below.

In the illustrated embodiment, a gap 78 is created by virtue of the attachment of the magnetic sleeve 56 to the bearing housing 64. The presence of the gap 78, which is in fluid communication with the coolant 36 disposed in the outer housing 11, enables the impingement of the coolant 36 directly upon the magnetic sleeve inner surface 56C and the bearing housing outer surface 64B during tube operation in order to remove heat therefrom. The gap 78 therefore serves as one means for removing heat from the magnetic sleeve 56.

In the illustrated embodiment, the head portion 64C of the bearing housing 64 has a greater diameter at the point of attachment with the magnetic sleeve 56 than the rest of the body 64A, thereby creating the gap 78. As best seen in FIG. 2, the gap 78 radially extends between the outer surface 64B of the bearing housing 64 and the inner surface 56C of the magnetic sleeve 56, and longitudinally extends from near the first end 56D to the second end 56E of the magnetic sleeve. The preferable radial thickness of the gap 78 is in the range of approximately 0.1 to 0.25 inch, though this thickness may be varied as required for the particular application involved. The longitudinal length of the gap 78 may also be varied according to the particular application involved, but preferably ranges from about 50% to 90% of the longitudinal length of the bearing housing 64.

The gap 78 is one component in providing augmented cooling to the rotor assembly 50. During operation of the x-ray tube 10, heat produced in the anode 14 is radiated and conducted to the rotor assembly 50, particularly to the rotor sleeve 62 and the bearing assembly 54. In the case of the rotor sleeve 62, some of the heat received thereby is radiated outward from the outer surface 62B toward the bottom section 12B of the vacuum enclosure 12. This heat is absorbed by the vacuum enclosure 12, which then transmits it to the coolant 36 that continually circulates via the cooling system of the x-ray tube 10 past the outer surfaces of the enclosure during tube operation.

A significant portion of the heat in the rotor sleeve 62, however, is also radiated inward from the inner surface 62C toward the adjacent outer surface 56B of the magnetic sleeve 56. As a result of the various features of the present invention, the magnetic sleeve 56 is able to continuously and effectively dissipate heat received in this manner. Specifically, one means for removing heat from the magnetic sleeve 56 comprises circulation of the coolant 36 within the gap 78. As a natural consequence of its movement through the outer housing 11, the coolant 36 infiltrates and continuously circulates through the gap 78. Thus, the coolant 36 is able to flow past the inner surface 56C of the magnetic sleeve 56, thereby convectively absorbing the heat contained in the sleeve. Given the large surface area of the magnetic sleeve inner surface 56C, this convective heat transfer is substantially efficient and helps prevent excessive heating of the bearing assembly 54.

As mentioned above, heat from the anode 14 is also conducted to the bearing housing 64 via the rotor shaft 58 and the bearing shaft 68. This heat is also effectively dissipated by way of the gap 78, which is disposed adjacent the bearing housing outer surface 64B. Circulating coolant present in the gap 78 during tube operation continuously absorbs heat from the outer surface 64B of the bearing housing 64, thereby preventing excessive heat buildup in the housing and avoiding heat related problems with the bearing sets 70.

Note that the coolant 36 circulated through the gap 78 may comprise any one of a variety of materials that may perform the desired cooling. For instance, the coolant 36 could comprise air or other gases that are circulated through the gap 78 during tube operation in order to remove excess heat. Accordingly, such other materials are understood as being part of the present invention.

To enhance heat transfer from the rotor assembly 50 to the coolant 36, various surfaces of the assembly may be treated to improve their emissivity or absorptivity. In the illustrated embodiment, these surfaces include the outer and inner surfaces 62B and 62C of the rotor sleeve 62, and the outer surface 56B of the magnetic sleeve 56.

The outer and inner surfaces 62B and 62C of the rotor sleeve 62 are preferably treated such that they comprise thermally emissive surfaces. In this way, heat conducted and radiated to the rotor sleeve 62 by the anode 14 is readily dissipated via the emissive outer and inner surfaces 62B and 62C to the vacuum enclosure 12 and to the magnetic sleeve 56, respectively.

In one embodiment, the emissive surface is formed via an emissive coating 80 applied to the rotor sleeve outer and inner surfaces 62B and 62C. The emissive coating 80 is applied using known application methods, such as plasma spray, sputtering, and deposition, though it is appreciated that a variety of alternative application techniques could be used. Preferable emissive coatings 80 that may be applied to the rotor sleeve outer and inner surfaces 62B and 62C include titanium dioxide, aluminum oxide, chromium oxide, and iron oxide. In addition to these, other materials could be utilized that provide the desired emissive surface characteristics of the emissive coating 80.

In lieu of applying it to the rotor sleeve outer and inner surfaces 62B and 62C as described above, the emissive coating 80 could formed by other techniques. One such technique involves adding small amounts of chromium to the material from which the rotor sleeve 62 is to be manufactured. After completing its manufacture, the rotor sleeve 62 is fired in a wet hydrogen environment to "green" the surfaces of the sleeve, that is, to form an emissive coating 80 comprising chromium oxide on the surfaces thereof.

As a general example of the greening technique above, a copper/chromium alloy may be formed by heating approximately 1.5% chromium with approximately 98.5% OFHC copper. Once melted, the copper/chromium alloy may be cast to form the rotor sleeve 62. Then, the rotor sleeve 62 may be subjected to a wet, heated hydrogen environment for a time sufficient to green the surface of the sleeve with an emissive coating 80 comprising chromium oxide. Further details concerning this technique, as well as details concerning the composition and methods of application of the thermally emissive coatings discussed above, are found in U.S. Pat. No. 6,282,262, issued Aug. 28, 2001, and U.S. patent application Ser. No. 09/672,627, filed Sep. 28, 2000, which are hereby incorporated by reference in their entirety.

In like manner to that described above, an absorptive coating 82 may be disposed on the outer surface 56B of the magnetic sleeve 56 in order to improve its ability to absorb heat emitted by the rotor sleeve inner surface 62C. The absorptive coating 82 may comprise any of the coatings outlined above, namely, titanium dioxide, aluminum oxide, chromium oxide, or iron oxide. Alternatively, the coating 82 may comprise other coatings not specifically mentioned herein that perform the same function. In one embodiment, wherein the magnetic sleeve 56 comprises iron, the absorptive coating 82 preferably comprises iron oxide and is disposed on the outer surface 56B using one of the methods of application described above. Generally, the same techniques described above that may be used to dispose the emissive coating 80 on the surfaces of the rotor sleeve 62 may also be employed to dispose the absorptive coating 82 on the magnetic sleeve 56.

With the absorptive coating 82 disposed on the magnetic sleeve 56, heat radiated from the rotor sleeve inner surface 62C during tube operation is readily absorbed by the coated magnetic sleeve outer surface 56B. The heat is then transmitted through the sleeve body 56A and then continuously convected away from the inner surface 56C to the coolant 36 disposed in the gap 78, as described above. In sum, the use of emissive and absorptive coatings 80 and 82 on the rotor sleeve 62 and magnetic sleeve 56 of the rotor assembly 50 is one feature of the present invention that allows for augmented heat transfer from the rotor assembly in order to avoid damage to heat sensitive components, such as the bearing sets 70.

Figure 3:
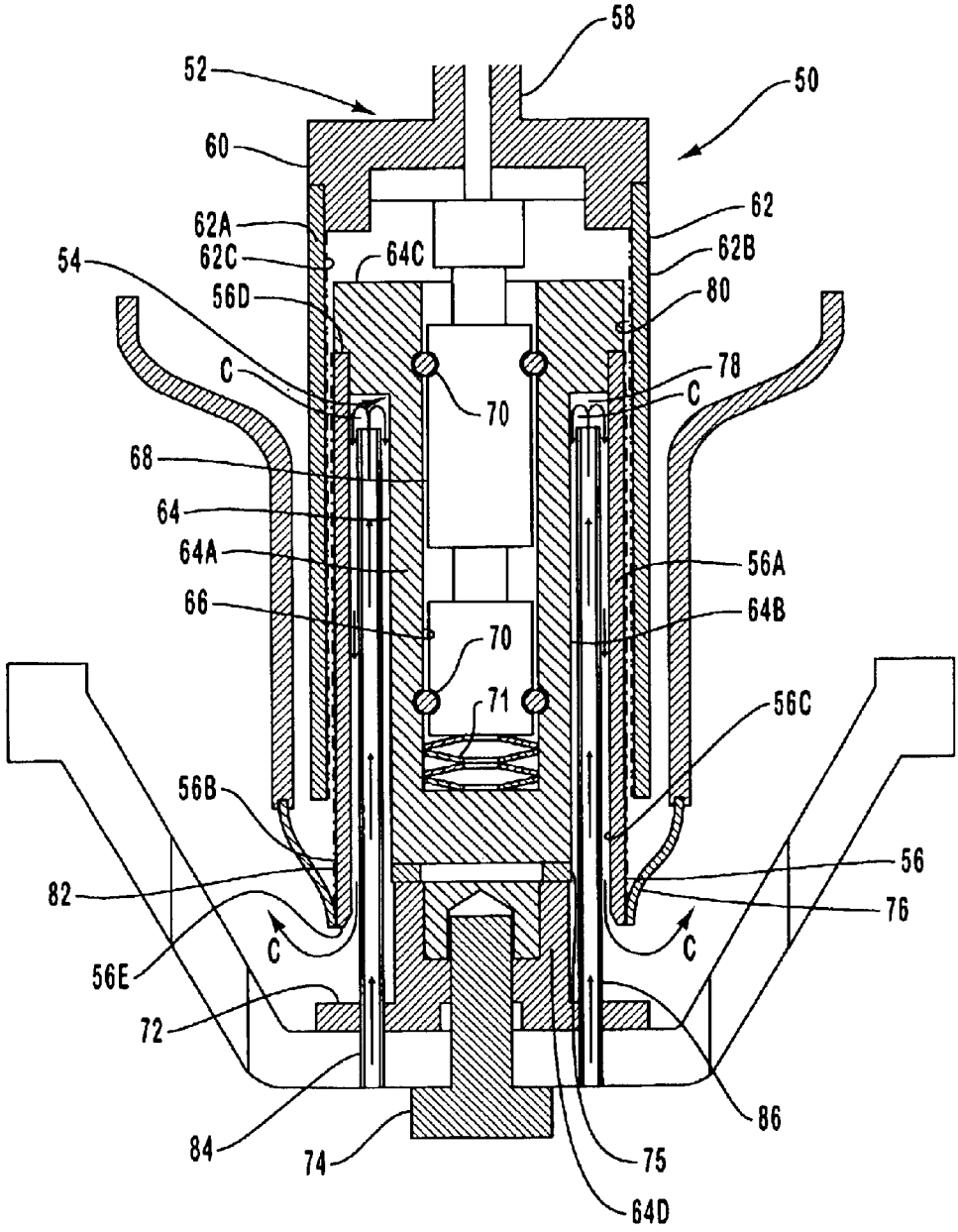
FIG. 3 is a cross sectional view of an alternative embodiment of the present rotor assembly, depicting various features thereof.

Reference is now made to FIG. 3, which depicts an alternative embodiment of the present rotor assembly 50. In this embodiment, another means for removing heat from the magnetic sleeve 56 of the rotor assembly 50 is shown, comprising a plurality of fluid passageways 84. In the illustrated embodiment, the fluid passageways 84 are axially defined both through the collet 72, which supports the bearing assembly 54, and through the anode support cone 24 supporting the collet. The fluid passageways 84 facilitate the injection of the coolant 36 into the gap 78 during tube operation by defining a more direct coolant flow path. This, in turn, helps prevent thermal stagnation of the coolant 36 within the gap 78, which otherwise causes a reduction in heat transfer between the magnetic sleeve 56, the bearing housing 64, and the coolant.

In one embodiment, six fluid passageways 84 are defined in the collet 72 and the anode support cone 24. The fluid passageways 84 are disposed near the circular periphery of the collet 72 and are preferably longitudinally aligned with the gap 78 such that the coolant 36 entering from the bottom of the collet is injected directly into the gap. It is recognized however, that the fluid passageways 84, while conforming to the desired functionality, could vary in number, size, and orientation.

As best seen in FIG. 3, the fluid passageways 84 further comprise a plurality of hollow, elongated tubes 86 attached to the portion of the fluid passageways defined in the collet 72. The tubes 86 extend into the gap 78 and are attached to the fluid passageways 84 by any suitable mode, including welding, brazing, threading engagement, or integral formation therewith. Like the collet 72, the tubes 86 can be composed of any suitable material, such as steel or copper. The number, length, and diameter of the tubes 86 may be varied according to the size of the gap 78 and the cooling needs of the rotor assembly 50.

The fluid passageways 84 and the tubes 86 facilitate efficient circulation of the coolant 36 through the gap 78, thereby contributing to the cooling of the rotor assembly 50 and avoiding thermal stagnation of the coolant. As was described above, the coolant 36 is typically circulated by a pump through the outer housing in a continuous fashion. In one embodiment, the coolant generally enters the outer housing 11 near the bottom end thereof, and is directed toward the top of the housing while circulating past the various internal tube components before exiting at the top. After initial entry into the outer housing 11, a portion of the coolant 36 is directed to and enters the fluid passageways 84. The coolant 36, given its prevailing flow from the bottom of the outer housing 11 to the top thereof, travels up and through the fluid passageways 84 and the tubes 86. The coolant 36 and its flow path are indicated in FIG. 3 by arrows designated with the letter "C." Upon exiting the upper ends of the tubes 86, the coolant 36 travels down the exterior of the tubes 86, where it absorbs the heat from the outer surface 64B of the bearing housing and the inner surface 56C of the magnetic sleeve. The coolant continues its downward path until reaching the second end 56E of the magnetic sleeve 56. At this point, the coolant 36 is ejected from the gap 78, and continues its journey to the opposite end of the outer housing 11 before exiting, transferring its heat to a heat exchanger or radiator, and re-entering the passageways 84 and tubes 86 assist in removing heat from the rotor assembly 50 via the magnetic sleeve 56 hand the bearing housing 64 while preventing the thermal stagnation of the coolant 36.

One skilled in the art will appreciate that the flow direction of the coolant 36 may be reversed without affecting the quality or quantity of cooling that is achieved. It will also be appreciated that an auxiliary pump or other suitable device or method may be employed to assist the circulation of the coolant 36 through the fluid passageways 84. Finally, note that the alternative embodiment of FIG. 2 depicts but one means for removing heat from the magnetic sleeve 56. Indeed, other configurations could be utilized for removing the heat via the gap 78.

Figure 4:
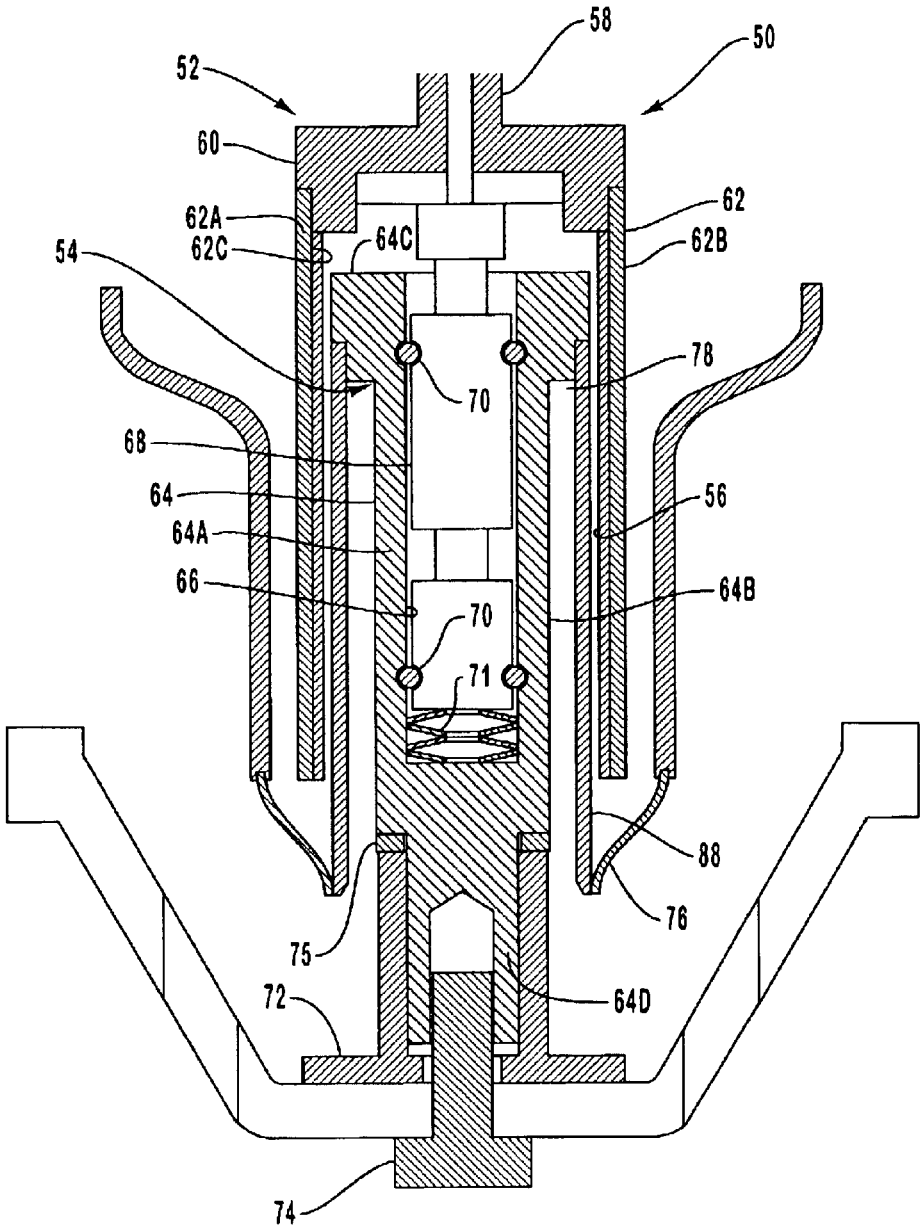
FIG. 4 is a cross sectional view showing various features of another alternative embodiment of the present rotor assembly.

Reference is now made to FIG. 4, which depicts another alternative embodiment of the present rotor assembly 50. In some x-ray tube configurations, it may be desirable to attach the magnetic sleeve 56 to the outer surface 64B of the bearing housing 64 such that no gap is defined therebetween. Alternatively, it may be desirable to attach the magnetic sleeve 56 to the inner surface 62C of the rotor shaft 62, such as is depicted in FIG. 4. In these cases, the outer periphery of the gap 78 need not be defined by the magnetic sleeve 56. Instead, another tube component may be disposed in its stead. In the illustrated embodiment, a cylindrical sleeve 88, similar in size and shape to the magnetic sleeve 56, is used to define the outer periphery of the gap 78.

In addition to defining the gap 78, the vacuum cylinder 88 of the present embodiment also performs the vacuum and heat dissipation functions formerly performed in previous embodiments by the magnetic sleeve 56, which is now integrally attached to the inner surface 62C of the rotor sleeve 62. The vacuum cylinder 88 may be composed of any suitable material upon which an absorptive coating 82 may be disposed, such as iron or steel.

For instance, the cylindrical sleeve 88 is hermetically attached to both the bearing housing 64 and the sealing ring 76 so as to maintain the vacuum within the vacuum enclosure 12. And during operation of the x-ray tube 10, the vacuum cylinder 88 receives heat transmitted by the rotor sleeve 62 and conveys that heat to the coolant-filled gap 78, thereby reducing heat build up in the rotor assembly 50 and preventing damage to its components. To assist in this heat dissipation, the vacuum cylinder 88 may be composed of any suitable material upon which an absorptive coating 82 may be disposed, such as iron or steel.

One skilled in the art will appreciate that various other configurations may be devised to perform the function described above in connection with the cylindrical sleeve 88. The above discussion is therefore not meant to be limiting of the present invention in any way.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A x-ray tube having an electron source and an anode disposed within an outer housing, a rotor assembly also disposed within the outer housing, the rotor assembly comprising:

a rotor shaft rotatably supporting the anode;

a bearing assembly connected to the rotor shaft, the bearing assembly comprising a bearing housing having an outer surface; and a cylindrical sleeve concentrically disposed about at least a portion of the bearing housing, the cylindrical sleeve being attached to the bearing housing such that a gap is defined between an inner surface of the cylindrical sleeve and the outer surface of the bearing housing, the gap allowing a coolant disposed in the outer housing to remove heat from at least a portion of the cylindrical sleeve.

2. A rotor assembly as defined in claim 1, wherein the cylindrical sleeve comprises a ferromagnetic material.

3. A rotor assembly as defined in claim 1, wherein the gap extends from near a first end of the cylindrical sleeve to at least second end of the cylindrical sleeve.

4. A rotor assembly as defined in claim 1, further comprising a rotor sleeve attached to the rotor shaft, wherein the rotor sleeve comprises an outer surface and an inner surface, and wherein the rotor sleeve is concentrically disposed about at least a portion of the cylindrical sleeve.

5. A rotor assembly as defined in claim 1, further comprising a thermally emissive coating disposed on the inner surface of the rotor sleeve.

6. A rotor assembly as defined in claim 5, further comprising a thermally emissive coating disposed on the outer surface of the rotor sleeve.

7. A rotor assembly as defined in claim 6, wherein the thermally emissive coatings disposed on the inner and outer surfaces of the rotor sleeve are selected from group consisting of: titanium dioxide, aluminum oxide, chromium oxide, and iron oxide.

8. A rotor assembly as defined in claim 1, further comprising a thermally absorptive coating disposed on the outer surface of the cylindrical sleeve.

9. A rotor assembly as defined in claim 8, wherein the thermally absorptive coating is selected from the group consisting of: titanium dioxide, aluminum oxide, chromium oxide, and iron oxide.

10. A rotor assembly as defined in claim 1, wherein the coolant disposed in the outer housing comprises dieletric oil.

11. An x-ray tube, comprising:

an electron-emitting cathode;

an anode positioned to receive the electrons emitted by the cathode;

a rotor assembly rotatably supporting the anode, comprising:

a rotor shaft;

a bearing assembly connected to the rotor shaft, the bearing assembly comprising a bearing housing having an outer surface;

a magnetic sleeve concentrically disposed about at least a portion of the bearing housing, the magnetic sleeve also being attached to the bearing housing; and a rotor sleeve attached to the rotor shaft, the rotor sleeve comprising an outer surface and an inner surface and being concentrically disposed about at least a portion of the magnetic sleeve;

a vacuum enclosure in which the cathode, anode, and the rotor assembly are at least partially disposed, the vacuum enclosure including a first end and a second end, the second end of the vacuum enclosure being hermetically attached to the magnetic sleeve; and means for removing heat from the magnetic sleeve.

12. An x-ray tube as defined in claim 11, wherein the means for removing heat from the magnetic sleeve comprises a gap defined between an inner surface of the magnetic sleeve and the outer surface of the bearing housing.

13. An x-ray tube as defined in claim 12, wherein the gap longitudinally extends from near a first end of the magnetic sleeve to at least a second end of the magnetic sleeve.

14. An x-ray tube as defined in claim 12, wherein the gap is circumferentially defined about the outer surface of the bearing housing.

15. An x-ray tube as defined in claim 12, wherein the means for removing heat from the magnetic sleeve further comprises a coolant that is continuously circulated through the gap.

16. An x-ray tube as defined in claim 15, further comprising a collet, the collet supportably receiving a portion of the bearing housing.

17. An x-ray tube as defined in claim 16, wherein the means for removing heat from the magnetic sleeve further comprises a plurality of fluid passageways defined in the collet, wherein the fluid passageways are in fluid communication with the gap.

18. An x-ray tube as defined in claim 17, wherein the fluid passageways further comprise elongated tubes that extend into the gap, and wherein the coolant is continuously circulated through the fluid passageways.

19. An x-ray tube as defined in claim 11, further comprising a thermally emissive coating disposed on at least a portion of the rotor sleeve.

20. An x-ray tube as defined in claim 11, further comprising a thermally absorptive coating disposed on at least a portion of the outer surface of the magnetic sleeve.

21. An x-ray tube, comprising:

an outer housing in which is disposed:

an electron-emitting cathode;

an anode positioned to receive electrons emitted by the cathode;

a rotor assembly rotatably supporting the anode, comprising:

a rotor shaft;

a bearing assembly connected to the rotor shaft, wherein the bearing assembly comprises a bearing housing having an outer surface;

a magnetic sleeve concentrically disposed about at least a portion of the bearing housing, wherein the magnetic sleeve comprises an outer surface, an inner surface, and first and second ends, and wherein the first end is attached to the bearing housing such that a radially and longitudinally extending gap is defined between the inner surface of the magnetic sleeve and the outer surface of the bearing housing; and a rotor sleeve attached to the rotor shaft, wherein the rotor sleeve comprises an outer surface and an inner surface, and wherein the rotor sleeve is concentrically disposed about at least a portion of the magnetic sleeve;

a vacuum enclosure in which the cathode, the anode, and the rotor assembly are disposed, the vacuum enclosure comprising:

a substantially cylindrical portion having a first end and a second end; and a sealing ring having one end hermetically attached to the second end of the substantially cylindrical portion, and having the other end hermetically attached to the second end of the magnetic sleeve; and a coolant disposed between the outer housing and the vacuum enclosure, wherein the coolant is in fluid communication with the gap.

22. An x-ray tube as defined in claim 21, wherein the magnetic sleeve structurally supports the vacuum enclosure.

23. An x-ray tube as defined in claim 21, wherein the magnetic sleeve comprises iron.

24. An x-ray tube as defined in claim 23, wherein the outer surface of the bearing housing defines a first diameter and a second diameter, the second diameter being less than first diameter, wherein the magnetic sleeve is attached to the portion of the outer surface of the bearing housing defining the first diameter, and wherein the gap is defined between the inner surface of the magnetic sleeve and the portion of the outer surface of the bearing housing defining the second diameter.

25. An x-ray tube as defined in claim 24, wherein the gap longitudinally extends from near the first end of the magnetic sleeve to at least the second end of the magnetic sleeve.

26. An x-ray tube as defined in claim 25, wherein the radial thickness of the gap is in the range of approximately 0.1 to 0.25 inch.

27. An x-ray tube as defined in claim 24, further comprising a collet, wherein the collet receives a portion of the bearing housing.

28. An x-ray tube as defined in claim 27, wherein the collet defines a plurality of fluid passageways that are in fluid communication with the gap.

29. An x-ray tube as defined in claim 28, wherein the fluid passageways further comprise elongated tubes that extend into the gap.

30. An x-ray tube as defined in claim 29, wherein six fluid passageways extend into the gap.

31. An x-ray tube as defined in claim 30, further comprising a thermally emissive coating disposed on the inner and outer surfaces of the rotor sleeve.

32. An x-ray tube as defined in claim 31, wherein the thermally emissive coatings disposed on the inner and outer surfaces of the rotor sleeve are selected from group consisting of: titanium dioxide, aluminum oxide, chromium oxide, and iron oxide.

33. An x-ray tube as defined in claim 32, further comprising a thermally absorptive coating disposed on the outer surface of the magnetic sleeve.

34. An x-ray tube as defined in claim 33 directly above, wherein the thermally absorptive coating is selected from the group consisting of: titanium dioxide, aluminum oxide, chromium oxide, and iron oxide.

35. A method for removing heat from an x-ray tube, the x-ray tube including a rotor assembly comprising a rotor sleeve that is concentrically disposed about a magnetic sleeve, the magnetic sleeve being concentrically disposed about and attached to a bearing housing, the method comprising the steps of:

defining a gap between the magnetic sleeve and the bearing housing;

introducing a coolant into the gap, wherein heat is transferred from the magnetic sleeve to the coolant; and removing the coolant from the gap.

36. A method for removing heat as defined in claim 35, wherein the introducing step comprises the step of:

introducing a coolant into the gap via a plurality of fluid passageways disposed at least partially in the gap.

37. A method for removing heat as defined in claim 35, wherein the removing step comprises the step of:

removing the coolant from the gap via a plurality of fluid passageways disposed at least partially in the gap.

38. A method for removing heat as defined in claim 35, further comprising the steps of:

cooling the coolant that has been removed from the gap; and reintroducing the coolant into the gap.

* * * * *

UNITED STATES PATENT AND TRADEMARK OFFICE

CERTIFICATE OF CORRECTION

PATENT NO. : 6,751,292 B2
DATED : June 15, 2004
INVENTOR(S) : Andrews et al.

It is certified that error appears in the above-identified patent and that said Letters Patent is hereby corrected as shown below:

Column 6,
Line 2, change "FIG.1." to -- FIG. 2. --.
Line 27, after "outer housing" change "111," to -- 11, --.

Column 7,
Line 6, before "outer surface 64B," remove "and".
Line 20, before "each of the bearing sets 70" insert -- of --.
Line 27, before "the anode support cone" remove "zoo".

Column 9,
Line 22, before "formed by other techniques." insert -- be --.

Column 10,
Line 27, after "It is recognized" insert -- , --.
Line 67, before "passageways 84" insert -- housing to remove more heat from the tube components. In the way, the fluid --.

Column 11,
Line 2, after "sleeve 56" change "hand" to -- and --.

Column 12,
Line 26, after "are selected from" insert -- the --.

Column 14,
Line 3, after "being less than" insert -- the --.
Line 32, after "are selected from" insert -- the --.

Signed and Sealed this

Eleventh Day of April, 2006

JON W. DUDAS
*Director of the United States Patent and Trademark Office*